US009408516B2

(12) United States Patent
Bradbury et al.

(10) Patent No.: US 9,408,516 B2
(45) Date of Patent: Aug. 9, 2016

(54) FLOOR CLEANING DEVICE HAVING A DUST BIN AND A PANEL FOR HOLDING A CLEANING SHEET PROXIMATE THERETO

(71) Applicant: The Procter & Gamble Company, Cincinnati, OH (US)

(72) Inventors: Glenn Allen Bradbury, Mason, OH (US); Robert William Atter, Hong Kong (HK)

(73) Assignee: The Procter & Gamble Company, Cincinnati, OH (US)

( * ) Notice: Subject to any disclaimer, the term of this patent is extended or adjusted under 35 U.S.C. 154(b) by 83 days.

(21) Appl. No.: 14/516,621

(22) Filed: Oct. 17, 2014

(65) Prior Publication Data

US 2015/0033491 A1 Feb. 5, 2015

Related U.S. Application Data

(63) Continuation-in-part of application No. 13/524,491, filed on Jun. 15, 2012, now Pat. No. 8,910,340.

(51) Int. Cl.

| | |
|---|---|
| ***A47L 11/33*** | (2006.01) |
| ***A47L 11/40*** | (2006.01) |
| ***A47L 13/12*** | (2006.01) |
| ***A47L 13/16*** | (2006.01) |
| ***A47L 13/36*** | (2006.01) |
| ***A47L 13/44*** | (2006.01) |
| ***A47L 13/20*** | (2006.01) |

(52) U.S. Cl.

CPC ..... *A47L 13/16* (2013.01); *A47L 11/33* (2013.01); *A47L 11/4013* (2013.01); *A47L 11/4041* (2013.01); *A47L 11/4069* (2013.01); *A47L 13/12* (2013.01); *A47L 13/20* (2013.01); *A47L 13/36* (2013.01); *A47L 13/44* (2013.01)

(58) Field of Classification Search

CPC ..... A47L 13/16; A47L 13/36; A47L 13/44; A47L 13/52; A47L 11/33; A47L 11/4013; A47L 13/12

See application file for complete search history.

(56) References Cited

U.S. PATENT DOCUMENTS

| | | | | |
|---|---|---|---|---|
| 306,008 | A | 9/1884 | Drew | |
| 329,257 | A | 10/1885 | Bissell | |
| 1,725,762 | A * | 8/1929 | Lee | A47L 5/30 15/374 |
| 4,191,609 | A | 3/1980 | Trokhan | |
| 4,637,859 | A | 1/1987 | Trokhan | |
| 4,654,927 | A | 4/1987 | Novinger | |

(Continued)

FOREIGN PATENT DOCUMENTS

| | | | |
|---|---|---|---|
| CN | 2 917 533 | Y | 7/2007 |
| EP | 1027855 | A2 | 8/2000 |
| EP | 2 786 690 | A1 | 10/2014 |

*Primary Examiner* — Randall Chin

(74) *Attorney, Agent, or Firm* — Larry L. Huston; Steven W. Miller

(57) ABSTRACT

A foot for a device and a related device for cleaning a target surface and which can accept a sheet for contact with the target surface. The device also has a rotatable beater bar. The beater bar and sheet provide two cleaning modes for the device. The device has a foot which comprises a housing and forward lip for the beater bar and further has a sole plate for accepting the cleaning sheet. The lip and proximate edge of the sole plate are in spaced in relationship to each other. The proper spacing between the portion of the housing with the beater and sole plate holding the sheet, provides for improved dual mode cleaning performance. The cleaning system may be used to clean hard surfaces, such as a floor.

20 Claims, 10 Drawing Sheets

(56) References Cited

U.S. PATENT DOCUMENTS

| | | | | |
|---|---|---|---|---|
| 4,701,969 | A * | 10/1987 | Berfield | A47L 11/33 15/41.1 |
| 4,709,436 | A * | 12/1987 | Berfield | A47L 11/33 15/257.9 |
| 5,960,508 | A | 10/1999 | Holt et al. | |
| 6,101,661 | A | 8/2000 | Policicchio et al. | |
| 6,305,046 | B1 | 10/2001 | Kingry et al. | |
| 6,386,392 | B1 | 5/2002 | Argenieri et al. | |
| 6,716,805 | B1 | 4/2004 | Sherry et al. | |
| 6,797,357 | B2 | 9/2004 | Fereshtehkhou et al. | |
| 6,936,330 | B2 | 8/2005 | Fereshtehkou et al. | |
| 7,013,528 | B2 | 3/2006 | Parker et al. | |
| 7,134,161 | B2 | 11/2006 | Campos | |
| 7,144,173 | B2 | 12/2006 | Policicchio et al. | |
| 7,346,428 | B1 | 3/2008 | Huffman et al. | |
| D588,770 | S | 3/2009 | Koenig et al. | |
| 7,676,877 | B2 | 3/2010 | Policicchio et al. | |
| 8,186,898 | B2 | 5/2012 | Bradbury et al. | |
| 8,684,619 | B2 | 4/2014 | Uchiyama et al. | |
| 2005/0055792 | A1 | 3/2005 | Kisela et al. | |
| 2009/0077761 | A1 | 3/2009 | Kaleta et al. | |
| 2010/0287716 | A1 | 11/2010 | Kasper et al. | |
| 2013/0333129 | A1 | 12/2013 | Bradbury et al. | |
| 2014/0026344 | A1 | 1/2014 | Bradbury | |
| 2014/0250619 | A1 | 9/2014 | Policicchio et al. | |
| 2015/0033491 | A1 | 2/2015 | Bradbury et al. | |

* cited by examiner

FLOOR CLEANING DEVICE HAVING A DUST BIN AND A PANEL FOR HOLDING A CLEANING SHEET PROXIMATE THERETO

FIELD OF THE INVENTION

The present invention relates to devices having a sheet usable to clean a floor or other hard surfaces and more particularly to such devices having a removably attachable sheet.

BACKGROUND OF THE INVENTION

Cleaning of hard surfaces, such as floors (vinyl, linoleum, tile, cement), countertops, showers, etc. is well known in the art. Cleaning may be accomplished using cellulosic paper towels and non-woven sheets, as are well known in the art. Nonwoven sheets may be made according to commonly assigned U.S. Pat. No. 6,936,330 and/or U.S. Pat. No. 6,797,357. Cellulosic paper towels may be made according to commonly assigned U.S. Pat. No. 4,191,609 and/or U.S. Pat. No. 4,637,859.

Such sheets have been removably attached to manual implements. The implements increase reach, and improve ergonomics. For example, when the hard surface to be cleaned is a floor, the implement allows the user to clean from a standing position, improving comfort over cleaning from a crouched position or on the knees. Manual implements may be made according to commonly assigned U.S. Pat. Nos. 8,684,619; 6,305,046 and/or D588,770.

One problem encountered when cleaning floors is that a user can encounter tacky soils, which tend to stick to the floor, and/or encounter a variety of fine soils, such as dust, granular soils, dried food debris, plants, mud, etc. which tend to stick to the floor less. To improve cleaning of soluble and tacky stains, wetted and wettable floor sheets have been used. Prewetted floor sheets include those having APG polymers, as disclosed in commonly assigned U.S. Pat. No. 6,716,805. Wettable floor sheets have been used with the commercially available Swiffer WetJet® device. This device sprays cleaning solution onto the floor from a replaceable reservoir, as described in commonly assigned U.S. Pat. No. 8,186,898. Cleaning solution chemistry and a reservoir therefor may be made according to commonly assigned U.S. Pat. No. 6,386,392. Floor sheets which absorb cleaning solution from the floor may be made according to commonly assigned U.S. Pat. Nos. 5,960,508, 6,101,661 and/or U.S. Pat. No. 7,144,173.

But these attempts do not always sufficiently clean the entire range of soils encountered, particularly large particles, such as cereal and chunks of mud from the floor. To overcome the problem of loose, large particle cleaning, rotatable beater bars have been utilized, as disclosed in U.S. Pat. No. 9,783, reissued Jun. 28, 1881; U.S. Pat. No. 306,008 issued Sep. 30, 1884; U.S. Pat. No. 329,257 issued Oct. 27, 1885; U.S. Pat. No. 4,654,927 issued Apr. 7, 1987; U.S. Pat. No. 7,134,161 issued Nov. 14, 2006. The beater bars in these teachings are driven by the wheels. Particularly, each of these references teaches plural wheels contacting the floor to be cleaned. The wheels drive the beater bar, obviating the need for a separate electric motor. Electric motors add cost and weight to the device. Split beater bars have also been used, as shown in 2005/0055792 and U.S. Pat. No. 7,134,161.

Many mechanical sweepers use beater bars comprising nylon bristles. Bristles may also be used on carpets, where bristles can help loosen hair. Bristles can be prone to hair/lint/thread wrapping which may degrade performance. Since mechanical sweepers rely on momentum for pick-up, contaminated bristles reduce cleaning capability. Additionally, bristles can separate, requiring higher rotational speed to reduce bristle separation, and minimize particles passing through the bristles. Accordingly, some beater bars use fins or blades.

Powered devices may have a beater bar which is battery powered or AC line powered to aid in picking up soil. These devices have higher rotational speeds and can be more effective than mechanically driven beater bars at picking up particles. But powered devices can be inconvenient if battery life is depleted or cord length is insufficient.

Devices which also use a disposable sheet to assist in cleaning are known as illustrated by EP 1027855; US 2009/0077761; U.S. Pat. No. 7,013,528; U.S. Pat. No. 7,346,428 and commonly assigned U.S. Pat. No. 7,676,877. The disposable sheet may be attached to the implement using grippers, as described in commonly assigned 2014/0026344. Exemplary 2009/0077761, U.S. Pat. No. 7,013,528, U.S. Pat. No. 7,346,428 and EP 1027855 show the common arrangement of having a sheet attached to the bottom of the device. Commonly assigned U.S. Pat. No. 7,676,877 teaches a cleaning implement having a pivotable bottom wall to which a cleaning substrate may be attached. Commonly assigned 2013/0333129 teaches a device having a rotary beater bar and a cleaning sheet proximate thereto.

But even with dual mode pickup devices, having a beater bar followed by a cleaning sheet, not all debris may be captured from the target surface. One problem with devices having dual mode pickup is that debris may pass between the two pickup modes. E.g. debris not captured by the beater bar may bypass the cleaning sheet, and more specifically, debris may pass between a beater bar and sheet. If such debris is not captured, that debris remains on the floor and the cleaning task may be unsatisfactory.

One potential solution would be to provide a lip at the entrance to the beat bar pathway. The lip could drag on the floor similar to a dustpan. But this attempt at a solution may lead to drag in use and/or scratches on a wood floor. Clearly a better approach is needed to prevent bypass debris from remaining on the floor following cleaning.

SUMMARY OF THE INVENTION

The invention comprises a foot which accepts a removable sheet. The foot is movable on a surface and comprises a housing for holding a beater bar in a portion of the foot. A lip defines a rearward edge of the portion of the housing holding the beater bar. The foot also has a sole plate joined to the housing. The sole plate removably receives a disposable cleaning sheet thereon. The sole plate optionally pivots about a pivot axis between an open position for servicing of the cleaning sheet and optionally to a closed position for cleaning tasks. The sole plate has a distal edge proximate the lip. The lip and the distal edge defines predetermined gap therebetween, ranging from about −8 mm to about +8 mm.

DETAILED DESCRIPTION OF THE INVENTION

Figure 1A:
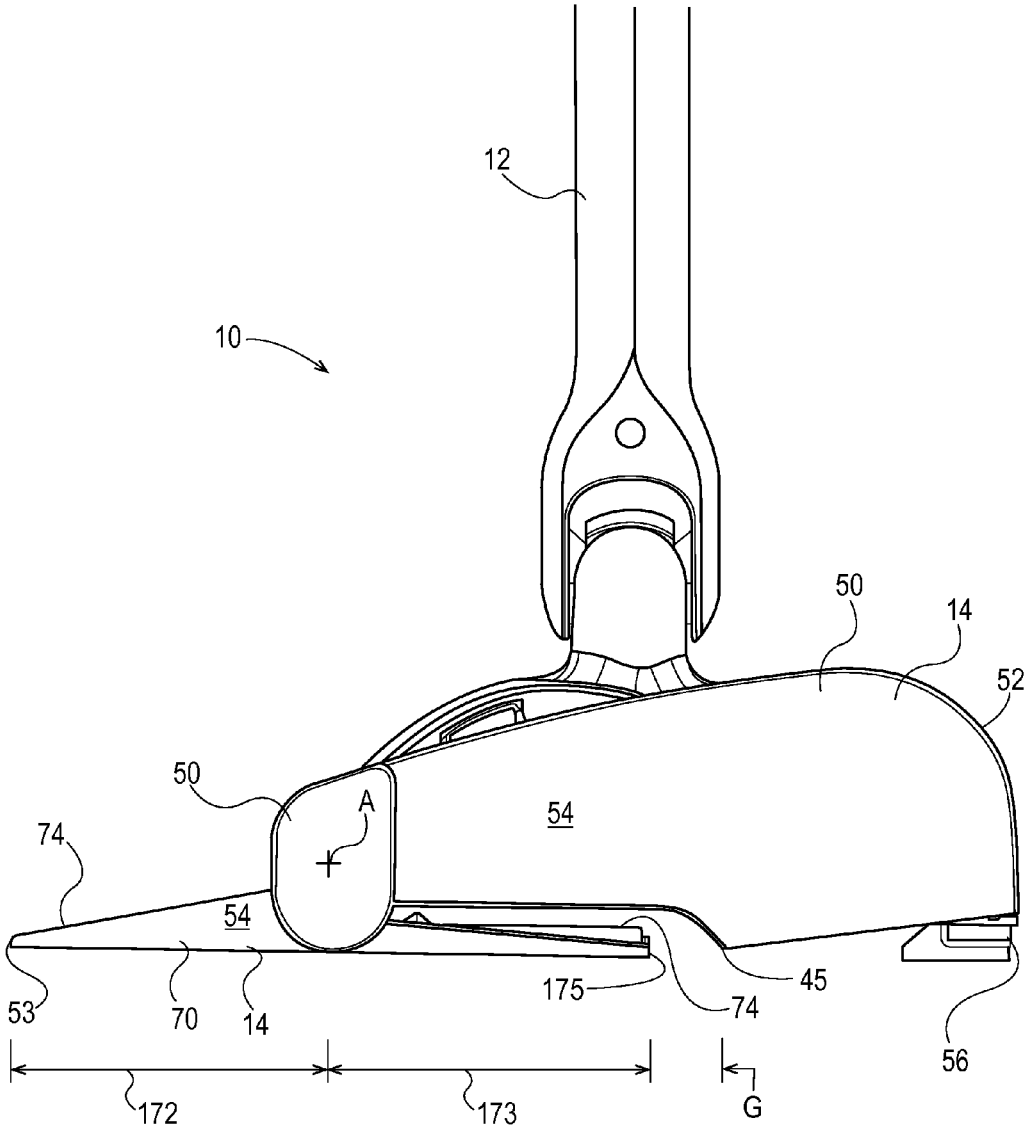
FIG. 1A is a side elevational view of a device of the present invention, with the sole plate shown in a closed position and shown with the front of the device facing right.
Figure 1B:
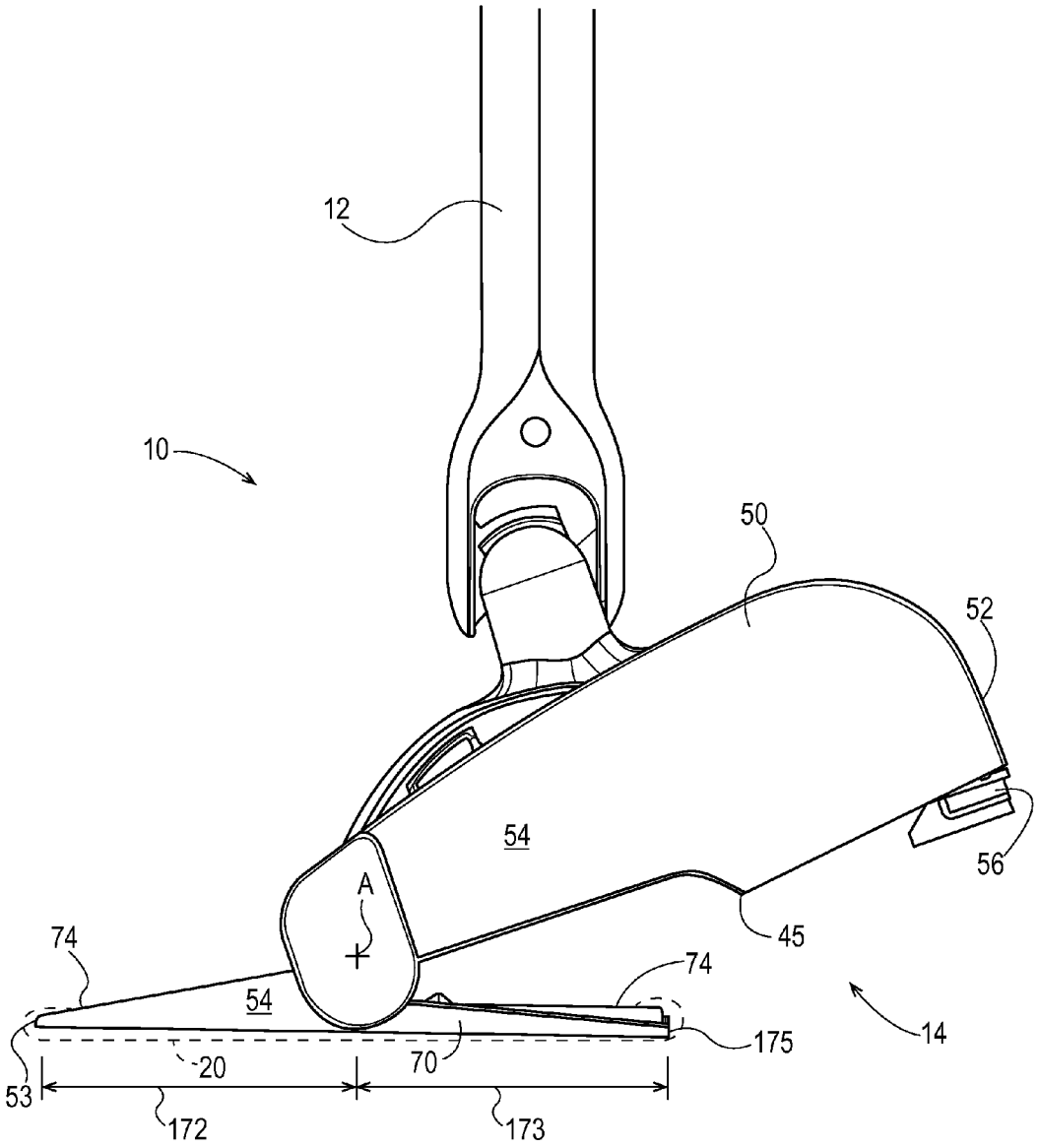
FIG. 1B is a side elevational view of the device of FIG. 1A, with the sole plate shown in an intermediate position and showing the cleaning sheet in phantom.
Figure 1C:
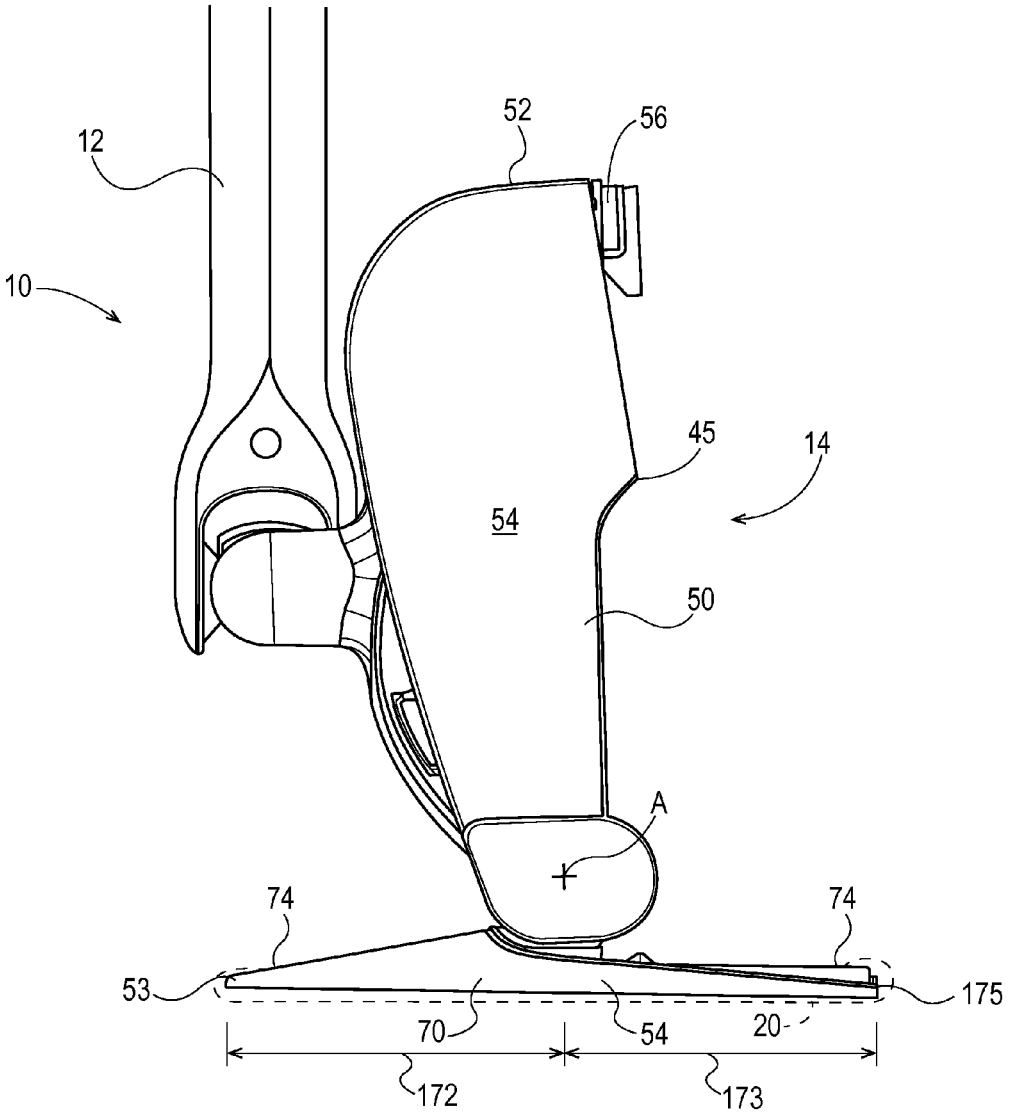
FIG. 1C is a side elevational view of the device of FIG. 1A, with the sole plate shown in a fully open position and showing the cleaning sheet in phantom.

Referring to FIGS. 1A-1C, the invention may comprise a dual mode surface cleaning device (10) for cleaning hard surfaces, such as floors, countertops, etc. The device (10) may comprise a handle (12) and a foot (14) mounted thereto in pivoting relationship. The pivoting relationship may include single axis pivoting relationship as occurs with a hinge or multi-axis pivoting relationship as occurs with a universal joint. Alternatively, if a small hand-held device (10) is desired, the handle (12) and foot (14) may be disposed in fixed relationship, so that countertops, showers and similar surfaces may be cleaned. The handle (12) and foot (14) may be permanently or removably connected together. Or a small hand held device (10) may comprise only a foot (14) and no handle (12).

The foot (14) may comprise a beater bar (44) on the bottom thereof, to provide a first mode of cleaning for crumbs, large particulates, etc. The foot (14) may removably receive a sheet (20) on the bottom thereof, to provide a second mode of cleaning, for dusts and smaller debris not captured by the first mode of cleaning.

Referring particularly to FIGS. 1B-1C, the floor sheet (20), or other cleaning cloth, usable with the present invention may comprise a textured nonwoven and more particularly a hydroentangled nonwoven. The nonwoven may comprise a single ply having three layers. The three layers may comprise a layer of carded fibers interposed between two layers of spunbonded fibers. The sheet (20) may be made according to commonly assigned U.S. Pat. Nos. 6,561,354; 6,645,604 and/or 2002/0042962.

Optionally, the sheet (20) may comprise a laminate construction, particularly if wet cleaning is contemplated with the present invention. The laminate may comprise at least one floor contacting layer and at least one absorbent, reservoir storage layer. A third, dedicated foot (14) contacting layer is optional and can be used for attachment to the device (10). Thus, the sheet (20) of the present invention may comprise 1, 2, 3, 4 or more layers.

In one embodiment, the fibers can be an airlaid nonwoven web comprising a combination of natural fibers, staple length synthetic fibers and a latex binder. The dry fibrous web can be about 20 to 80 percent by weight wood pulp fibers, 10 to 60 percent by weight staple length polyester fibers, and about 10 to 25 percent by weight binder. The dry sheet (20) can have a basis weight between about 30 and about 1000 grams per square meter.

Pre-moistened sheets (20) used in the system of the present invention may be advantageous in that they are always ready for use, and simple to use without special dosing. The user does not have to worry about applying too much cleaning solution, leading to waste, or too little cleaning solution to be efficacious. A pre-moistened sheet (20) may be made according to the teachings of commonly assigned U.S. Pat. No. 6,716,805. The sheet (20) may comprise a perforate or imperforate film, such as is known in the art for wetted floor sheets (20). An imperforate film will inhibit, if not prevent, transmission of steam or liquid therethrough, potentially reducing efficacy of the cleaning system.

The sheet (20) may be disposable after a single use. By disposable, it is meant that the sheet (20) is discarded after a single use of cleaning at least 5, 10, 15, 20 or more square meters and is not laundered or restored. Alternatively the sheet (20) may be laundered and restored for subsequent use. The sheet (20) can function as a scrubbing material and/or have additional materials added for scrubbing.

The sheet (20) may be generally rectangular, and sized to removably fit on the sole plate (70) of the device (10). The sheet (20) may have two opposed faces, an upper face for attachment to the sole plate (70) of the device (10), and a lower face which contacts and cleans the target surface. The sheet (20) may be removably attachable to the foot (14), and particularly to the sole plate (70) thereof using grippers (74) as described herein.

Figure 2A:
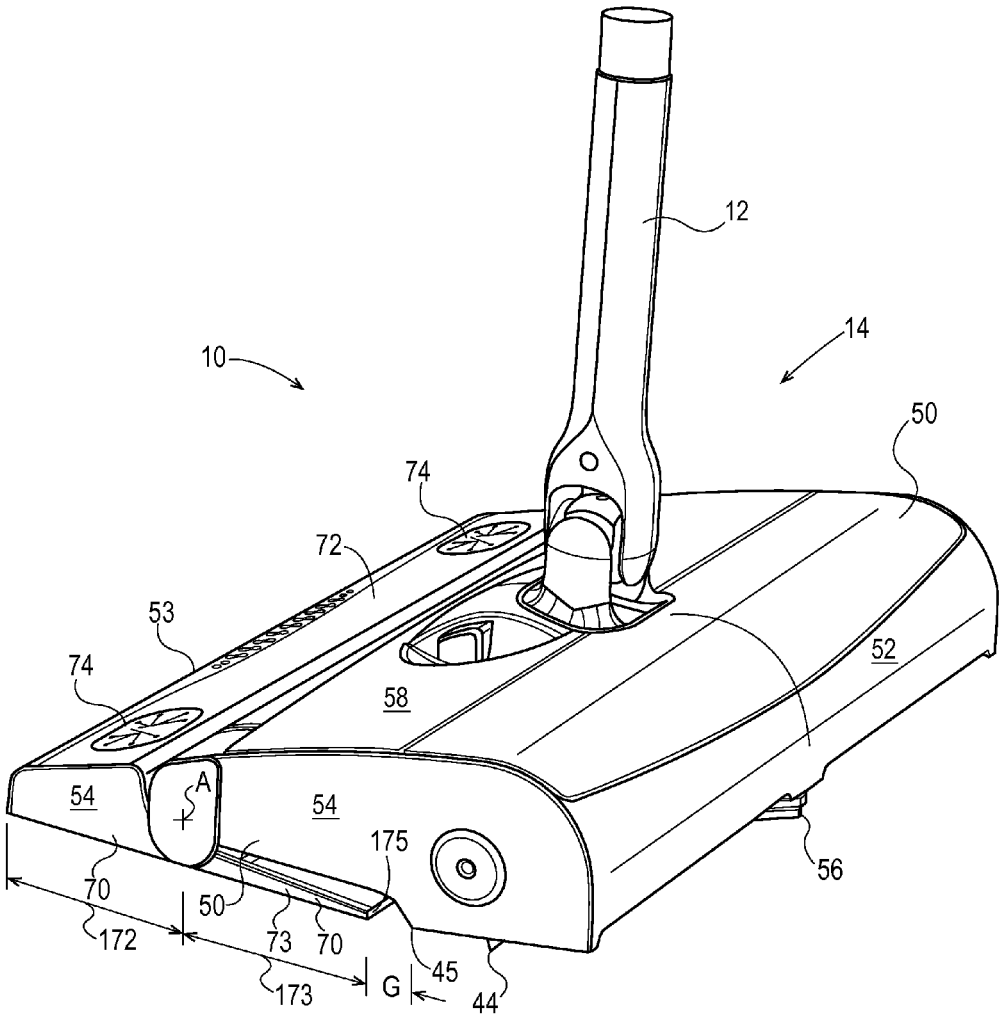
FIG. 2A is a front perspective view of an alternative embodiment of a device according to the present invention having a beater bar and raised head, with the sole plate shown in a closed position.
Figure 2B:
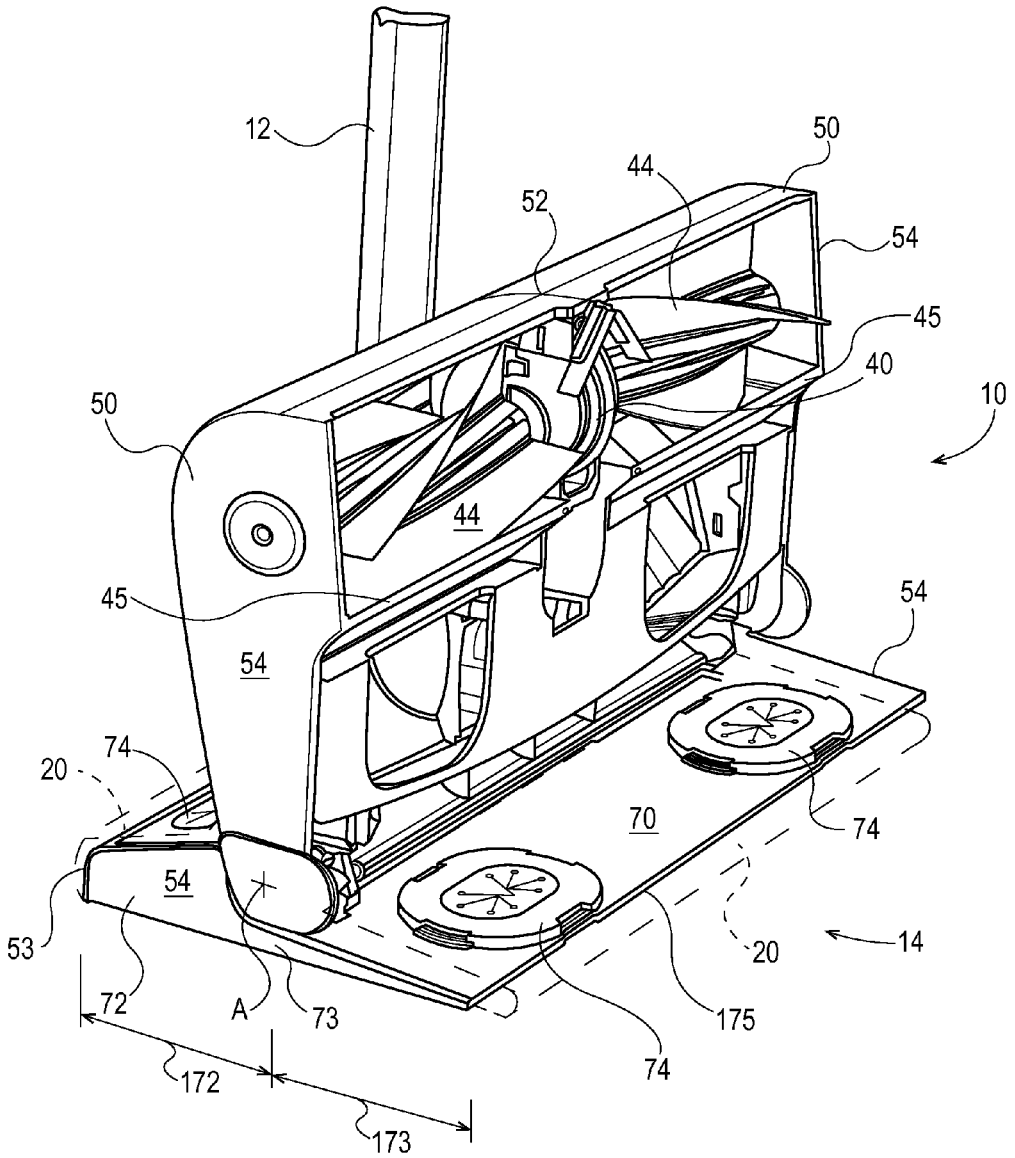
FIG. 2B is a front perspective view of the device of FIG. 2A with the sole plate shown in a fully open position and showing the cleaning sheet in phantom.
Figure 2C:
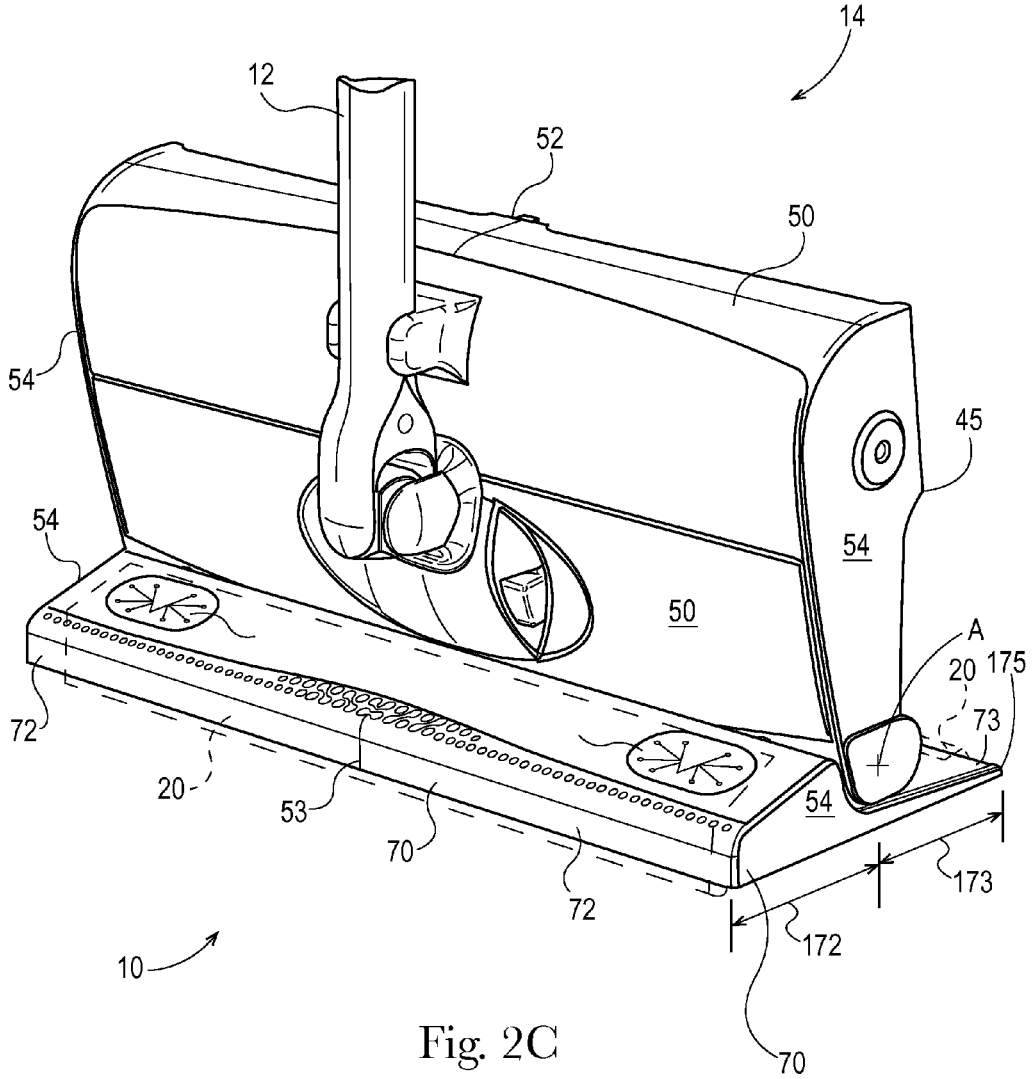
FIG. 2C is a rear perspective view of the device of FIG. 2B with the sole plate shown in a fully open position and showing the cleaning sheet in phantom.

Referring to FIGS. 2A-2C, the foot (14) may comprise a footprint large enough to accommodate the sheet (20). The foot (14) may be generally rectangular, having a front (52), rear (53) and two spaced apart sides (54). The foot (14) may comprise two mirror images, symmetrically opposite about a longitudinal centerline. The user may generally push the device (10) from front (52) to rear (53), and back, in a series of strokes.

The device (10) may comprise an axially rotatable beater bar (44), to remove debris from the floor. The beater bar (44) may be manually driven from a wheel or may be electrically powered, from an AC motor or DC motor as is known in the art. The beater bar (44) may sweep loose debris into a dirt bin (58), as described in 2010/0287716.

The optional beater bar (44) may be parallel to the widthwise direction of the foot (14) and parallel to the axle. The beater bar (44) may axially rotate about its axis on the forward stroke. Such rotation will collect large particles in an optional dirt bin (58). Smaller particles, not collected by the rotation of the beater bar (44), may be captured by the sheet (20) which trails the beater bar (44) on a forward stroke.

The beater bar (44) may be contained within a housing (50) for safety. The beater bar (44) may be parallel to the front (52)/rear (53) of the foot (14) and perpendicular to the longitudinal centerline. The device (10) may comprise two or more co-linear beater bars (44). The two beater bars (44) may be disposed with one on each side of the longitudinal centerline. Each beater bar (44) may be disposed on and rotate about an axle. Each axle may extend from the respective side (54) of the housing (50) to a trunnion juxtaposed with the longitudinal centerline. The axles may be locked in place by protrusions in the axles which fit into complementary detents in the trunnions. The beater bar (44) thus may be easily and conveniently removed and replaced, without having to undo belts, screws, etc.

Referring to FIG. 2B, the beater bar (44) may be disposed in a portion of the housing (50) defined in part by a lip (45). The lip (45) may be disposed on, or proximate to, the floor during use. The lip (45) may be parallel to and generally correspond in width to the beater bar (44). The lip (45) may scrape the floor and provide for the foot (14) to collect debris in use. The lip (45) may also provide an entrance for debris to enter a collection system, as discussed below relative to an exemplary dirt bin (58). The lip (45) may also define a rearward edge of the portion of the housing (50) which holds the beater bar (44).

Referring to FIG. 2A, the foot (14) may comprise an optional dirt bin (58) to receive debris from the beater bar (44) or other cleaning mode. At the end of the cleaning task, or when filled, the dirt bin (58) may be removed from the foot (14) through a cover in the housing (50) or by pivoting the housing (50) to an open position or by other access. Upon removal, the dirt bin (58) may be emptied or replaced. If desired, the dirt bin (58) may comprise part of the housing (50).

Referring to FIG. 2B, the foot (14) may comprise one or more wheels (40). A single wheel (40) may be disposed on the longitudinal centerline of the foot (14) as described in commonly assigned US 2013/0333129A1. The wheel (40) may be mounted towards the front (52) or rear (53) of the foot (14). The axis and axle may be parallel to the width direction of the foot (14), and perpendicular to the longitudinal centerline of the foot (14). The wheel (40) may have a diameter ranging from 18 to 63 mm and particularly be 43 mm. The wheel (40) may be relatively narrow at the circumference, to improve maneuverability. The wheel (40) may have a rubber periphery, to provide traction sufficient to drive each optional beater bar (44), if present. The beater bar(s) (44) may be driven in a 1:1 ratio with the wheel (40) or may be geared to be rotationally driven faster than the wheel (40), at a ratio ranging to 3, 4, 5 or 6:1 or more.

Referring to FIGS. 2A-2B, the foot (14) may further comprise an optional plow (56). The plow (56) may be chevron-shaped, arcuate, diagonally oriented with respect to the front (52) of the device, etc. The plow (56) may divert debris from the wheel to more directly be intercepted by the beater bar (44) and or sheet (20).

Referring to FIGS. 1A-1C, the housing (50) may have a removable or hingedly attached sole plate (70). Removal/pivoting of the sole plate (70) from/relative to the housing (50) may allow access to the, beater bars (44), dirt bin (58) and/or particularly the sheet (20). This arrangement allows the replacement of a beater bar (44) to occur without the use of tools, such as a screwdriver or pliers. The pivoting relationship of the sole plate (70) relative to the housing (50) described herein does not require 360 degree rotation of one relative to the other. Pivoting/articulation or other temporary removal of the sole plate (70) from the housing (50), need only intercept an angle/position sufficient to allow servicing [mounting/removal] of the sheet (20) in an open position and placement of the sheet (20)/sole plate (70) in the foot (14) in the closed position for cleaning tasks.

The entire sole plate (70) may hinge to an open position. As used herein, a housing (50) and sole plate (70) may be movable relative to each other. One may be held stationary, while the other is articulated or translated to/from a closed position to an open position and back. While a sole plate (70) hingedly attached to a housing (50) is shown, one of skill will recognize the invention is not so limited.

The sole plate (70) and housing (50) may be distinguished from each other by the housing (50) generally being larger and heavier than the sole plate (70). The housing (50) may serve as a frame for and provide attachment of components such as the wheel (40), beater bar (44) dirt bin (58) and/or other components.

The sole plate (70) may pivot about a pivot axis. This axis may be perpendicular to the longitudinal centerline and extend between the two spaced apart sides (54). The sole plate (70) has a forward portion (173) and rearward portion (172) opposingly disposed about the axis. The forward portion (173) and rearward portion (172) rotate about the axis in synchronus relationship, in response to manipulation by the user. If the user grasps either the forward portion (173) or rearward portion, and manipulates one portion (172, 173) to move relative to the housing (50), the other portion (172, 173) will likewise and simultaneously move an equal amount relative to the housing (50) and around the pivot axis. The forward portion (173) and rearward portion (172) may be joined in rigid relationship, to assure synchronus movement as the sole plate (70) rotates about the pivot axis relative to the housing (50).

The forward portion (173) may have a distal edge (175). The distal edge (175) of the forward portion (173) of the sole plate (70), and particularly of the panel (73) thereof, may be straight, parallel to and correspond in width to, the beater bar (44). The distal edge (175) may also be angled and/or tapered to direct particles to a specific portion of the beater bar (44).

Each of the forward portion (173) and rearward portion (172) of the sole plate (70) may have one or more grippers (74). This arrangement allows the sheet (20) to be attached to the sole plate (70) without attachment to or interference from the housing (50). The sheet (20) may be attached to the upwardly facing surfaces of both the forward portion (173) and rearward portion (172). The grippers (74) may be disposed on the upwardly facing surfaces, oriented away from the floor, of both the forward portion (173) and rearward portion (172).

This arrangement advantageously allows the sheet (20) to wrap both the front edge of the forward portion (173) and rear edge of the rearward portion (172). By wrapping both edges of the pivotable sole plate (70), snowplowing of debris in both the forward stroke direction and reverse stroke direction is reduced. Likewise dislodging of the free edge of the sheet (20) which wraps the sole plate (70) is less likely to occur than if a free edge of the sheet (20) is disposed on the bottom of the sole plate (70) and rubs on the floor or other surface being cleaned. Such benefits are not expected or predicted in the devices known in the prior art.

The sole plate (70) may comprise a generally planar panel (73), having the forward portion (173) and rearward portion (172) in generally mutually coplanar relationship. Alternatively the sole plate (70) may be curved, particularly convex outwardly. This geometry provides the benefit of concentrating pressure from the user onto a smaller portion of the sheet (20) and reducing snowplowing of debris in front of the sheet (20).

One or more grippers (74) may be disposed on the head (72) of the sole plate (70). One or more grippers (74) may be disposed on the panel (73) of the sole plate (70), and particularly may be disposed on the inner face thereof, as disclosed in commonly assigned application Ser. No. 13/947,501, filed Jul. 22, 2013. This arrangement provides for all grippers (74) to be disposed on the articulable sole plate (70). In this arrangement, no grippers (74) are disposed on the housing (50).

The sheet grippers (74) may comprise resilient fingers as shown in commonly assigned U.S. Pat. No. 6,305,046, U.S. Pat. No. 6,484,346 and U.S. Pat. No. 6,651,290 and US 20140026344. The grippers (74) may also or alternatively comprise hook and loop fasteners, adhesive, friction grips, clamps, etc. The grippers (74) may be exclusively disposed on the sole plate (70), as described herein. That is, the housing (50) may be free of grippers (74) and/or not require the use of grippers (74) to secure a sheet (20) to the foot (14). This arrangement provides the benefit that all grippers (74) can rotate together, and without relative movement between individual grippers (74) and be synchronously rotated together independent of the housing (50).

Referring to FIGS. 2A-2C, in a particular embodiment, the sole plate (70) may comprise a panel (73) and optional head (72) extending therefrom and particularly outwardly and/or upwardly therefrom. The head (72) may be disposed on the rearward portion (172) of the sole plate (70). The panel (73) may be disposed on or comprise the forward portion (173) of the sole plate (70). A large portion of the panel (73) may have a generally flat shape, and be generally planar. The panel (73) may have an interior face and exterior face opposed thereto. Such panel (73) portion of the sole plate (70) need not be flat, as shown, but may have a convex or other arcuate shape, as helpful. The panel (73) may have a proximal end near the head (72) and a distal end remote therefrom. The distal end of the panel (73) may have an edge for convenient wrapping of the sheet (20) therearound.

The head (72) may be integral with and/or rigidly attached to the panel (73). This arrangement provides the benefit, not found in the art, that as the sole plate (70) is moved, such during rotated to the open/closed positions, the head (72) and panel (73) are synchronized and move together without independent movement therebetween. Synchronus, simultaneous movement of the head (72) and panel (73) provide the benefit of less manipulation of the foot (14) during sheet (20) installation/replacement.

The head (72), and rearward portion (172) in particular, may be disposed at the back of the foot (14). The sole plate (70) may partially wrap the housing (50), providing for advantageous placement of the grippers (74) on the sole plate (70). One or more grippers (74) may be disposed on the inside of the sole plate (70), and particularly the inside of the panel (73). Similarly, one or more grippers (74) may be disposed on the top of the sole plate (70), and particularly the top of the head (72).

Figure 3A:
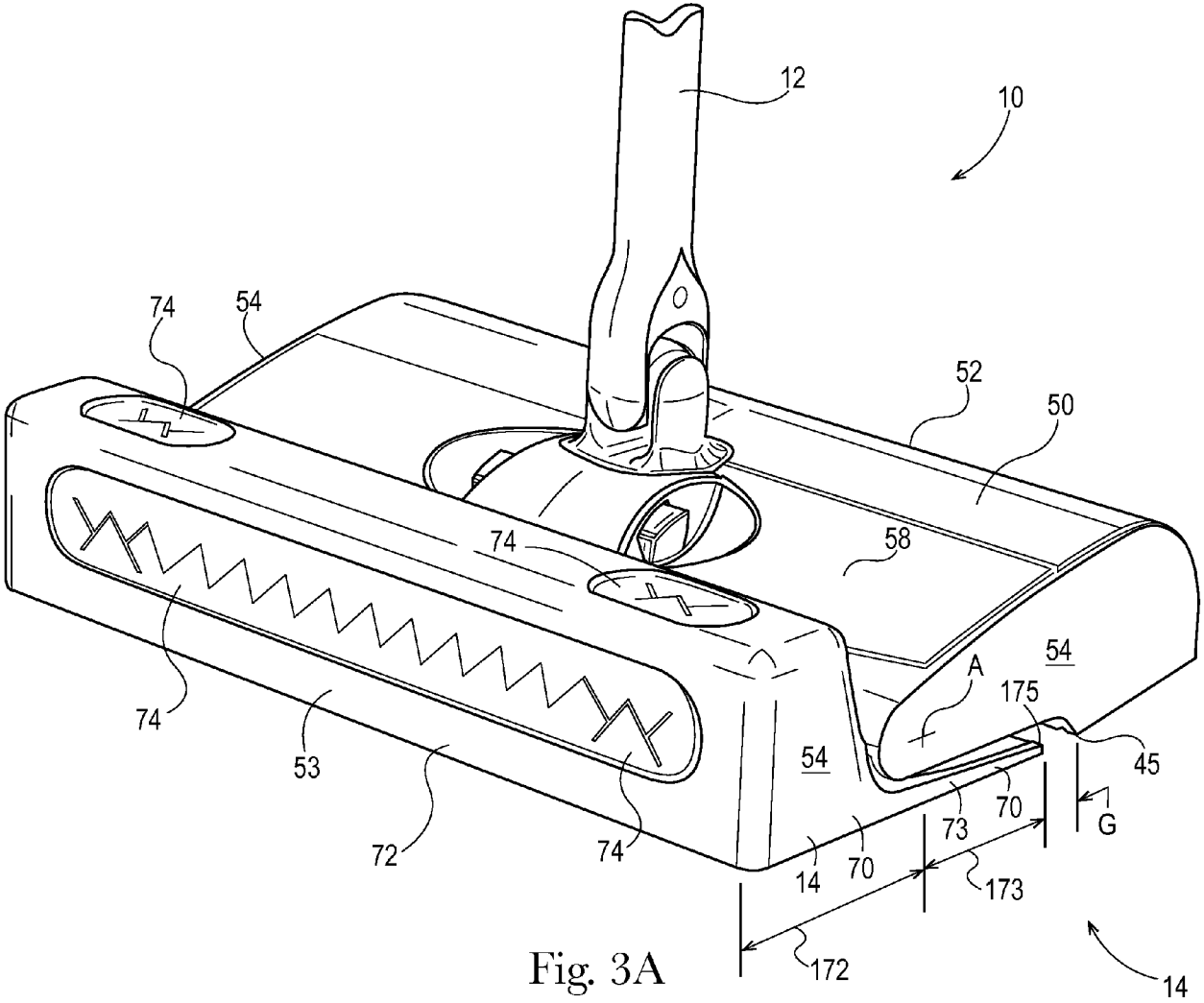
FIG. 3A is a rear perspective view of an alternative embodiment of a device according to the present invention having an optional dirt bin, dual gripper pairs to attach different cleaning sheet lengths, with the sole plate shown in a closed position.
Figure 3B:
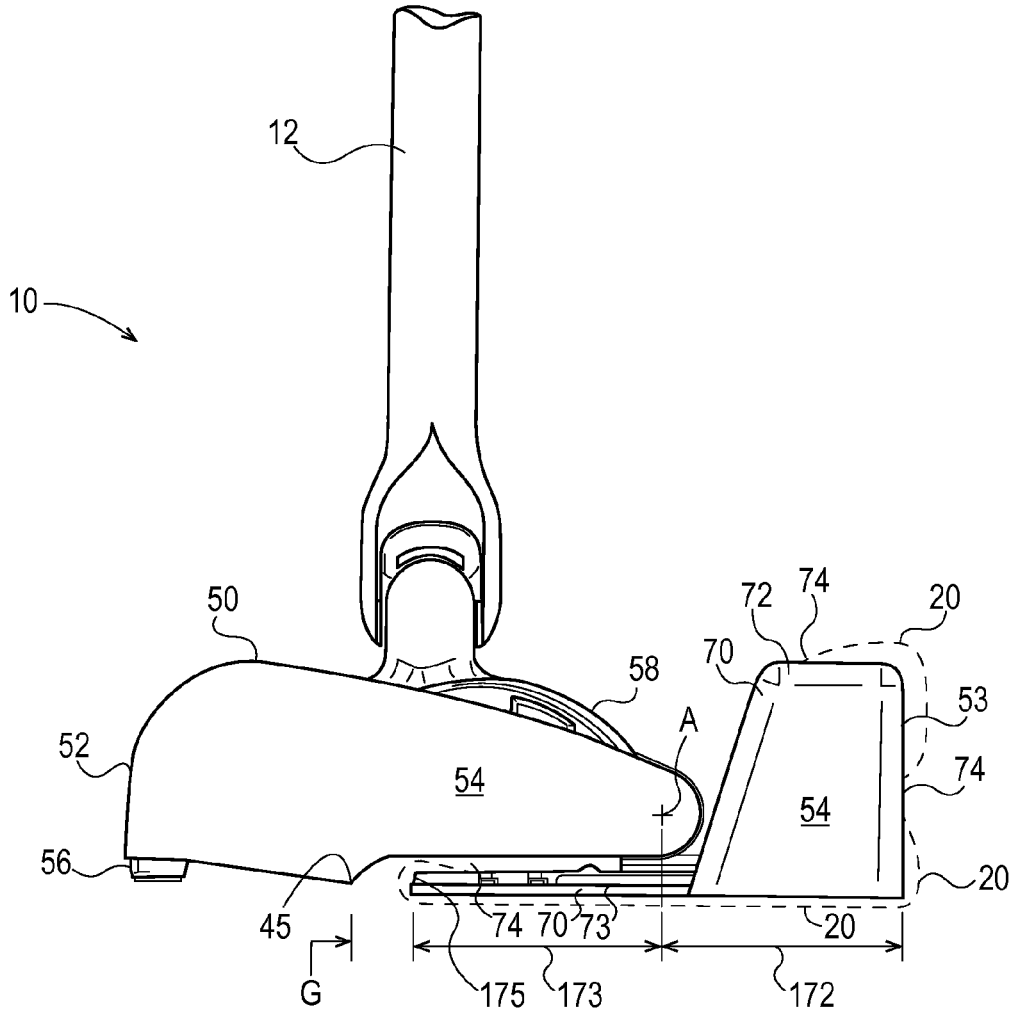
FIG. 3B is a side elevational view of the device of FIG. 3A and showing the cleaning sheet in phantom attached to two different sets of grippers.

Referring to FIGS. 3A and 3B, the head (72) may comprise grippers (74) which are disposed on the top thereof, and may be generally horizontally oriented. Alternatively or additionally, the grippers (74) may be disposed on the rear (53) of the head (72). This arrangement disposes the grippers (74) in a vertical orientation although one of skill will recognize the grippers (74) may be disposed in an orientation between vertical and horizontal. The dual sets of grippers (74) provides for the head (72) to accommodate different sheet (20) sizes.

The head (72) of FIGS. 3A and 3B has a generally vertically oriented surface. This surface provides the benefit that a portion of the sheet (20) may be vertically oriented for cleaning of baseboards, lower walls, etc. If desired, the rear (53) of the head (72) may be made of or lined with sponge, rubber, or other resiliently compliant material to conform to the profile of baseboards, molding, etc.

While the foot (14) is illustrated with the pivot axis near the center of the sole plate (70) and widthwise oriented, one of skill will recognize the invention is not so limited. The axis about which the sole plate (70) articulates may be parallel to the longitudinal centerline or skewed relative thereto, including being skewed relative to the horizontal plane. For example, the axis may be disposed on a side (54) of the sole plate (54). Of course, the side (54) of the sole plate (70) may be generally coplanar with the side (54) of the housing (50). Or the side (54) of the sole plate (70) may be inboard of the side (54) of the housing (50), or may be outboard thereof, so that the sole plate (70) and housing (50) have mutually different widths.

The foot (14) may further comprise a hinge, universal joint, ball and socket joint, etc. or portion thereof to pivotally receive a handle (12). Optionally and if small enough, the foot (14) may be used without a handle (12).

In yet another embodiment, the device (10) may optionally spray cleaning solution onto the floor or other target surface. This arrangement provides the benefit that the user can see where the cleaning solution is being applied, with it being blocked under the sheet (20). The cleaning solution may be any of the liquid solutions described above, aqueous or otherwise. The sprayer may be a pump system, as described with respect to commonly assigned U.S. Pat. No. 8,186,898, or a gravity feed system, either permanently/removably attached to the device (10) or a part thereof. Or a separate aerosol or trigger pump sprayer may be utilized, as are well known in the art. A spray system may be advantageously used with a single-use sheet (20), which is discarded after one cleaning event or with reusable sheets (20), such as microfiber sheets (20). If spray is used it will be advantageous to use dry absorbent sheets (20) such those described in commonly assigned U.S. Pat. No. 6,101,661; U.S. Pat. No. 7,144,173 and U.S. Pat. No. 7,163,349.

In yet another embodiment, the device (10) may optionally apply steam to the floor. The steam may be applied through a dry sheet or a pre-wetted sheet as disclosed in commonly assigned US 2013/0319463.

Figure 4:
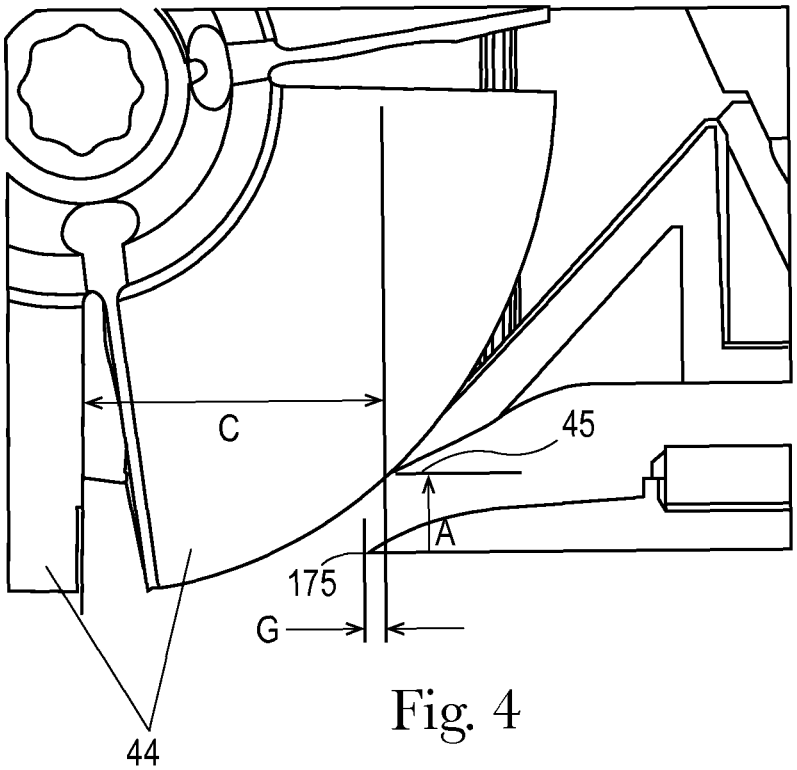
FIG. 4 is a vertical fragmentary sectional view of a device having a gap with an overlap and shown with the front of the device facing left.

Referring to FIG. 4, the lip (45) may be tapered to provide a flow path for debris to intercept the portion of the sheet (20) which wraps the top of the sole plate (70) and/or a flow path towards the dirt bin (58). In use, the lip (45) may be spaced a predetermined distance away from the floor as shown by distance A, to provide for an efficacious flow path and provide protection for the floor. Likewise, the distal edge (175) of the sole plate (70) may be spaced rearward of the axis of the beater bar (44) a predetermined distance as shown by distance C. If desired, the sheet (20) may wrap the lip (45) for attachment thereto, in lieu of attachment to the sole plate (70).

The lip (45) and the distal edge (175) of the sole plate (70) may be both substantially straight and substantially mutually parallel. By substantially straight it is meant that deviations beyond that which occur in ordinary manufacture, and typically less than 1 mm across the width of the foot (14), do not occur. By substantially parallel it is meant that deviations beyond that which occur in ordinary manufacture, and typically less than 2 degrees across the width of the foot (14), do not occur.

Referring to FIGS. 1A, 2A, 3A and 3B and 4, a gap (G) may separate the edge of lip (45) of the first cleaning mode and the distal edge (175) of the sole plate (70) which holds the sheet (20) for the second cleaning mode. The gap (G) is measured with the sole plate (70) in the in-use position. By in-use position it is meant that the device (10) has the housing (50) and sole plate (70) held in stationary, fixed relationship, corresponding to that position used during a routine cleaning task. Typically this position yields the smallest measurement of gap (G).

Gap (G) is then measured to yield the smallest gap (G) of the device (10), in a generally forward-backward direction and perpendicular to the width of the foot (14) and parallel to the beater bar (44). The gap (G) is measured using only the device (10), without having a sheet (20) in place.

If the gap (G) is not constant, the gap (G) is measured as the portion of the distal edge (175) having the most width which is constant and contiguous. If there is not a portion of the distal edge (175) which is constant, e.g. a sinusoidal or saw-tooth distal edge (175), the measurement is taken at the mid-point thereof. If the gap (G) extends for at least 25, 50 or 75 percent of the width of the foot (14), or for at least 10, 15, or 20 cm in the width direction, the gap (G) is considered to provide for efficacious, dual mode pickup of debris during cleaning and to meet the limitations of the following claims. The gap (G) may be measured using a Series 500 handheld depth gauge or dial calipers as are commonly available from Mitutoya America of Aurora, Ill.

If the distal edge (175) of the sole plate (70) barely intercepts the lip (45) of the housing (50), the gap is defined as 0. If there is an open space between the distal edge (175) and the lip (45), the gap (G) is defined as positive. If there is overlap between the distal edge (175) and the lip (45), the gap (G) is defined as negative.

Figure 5:
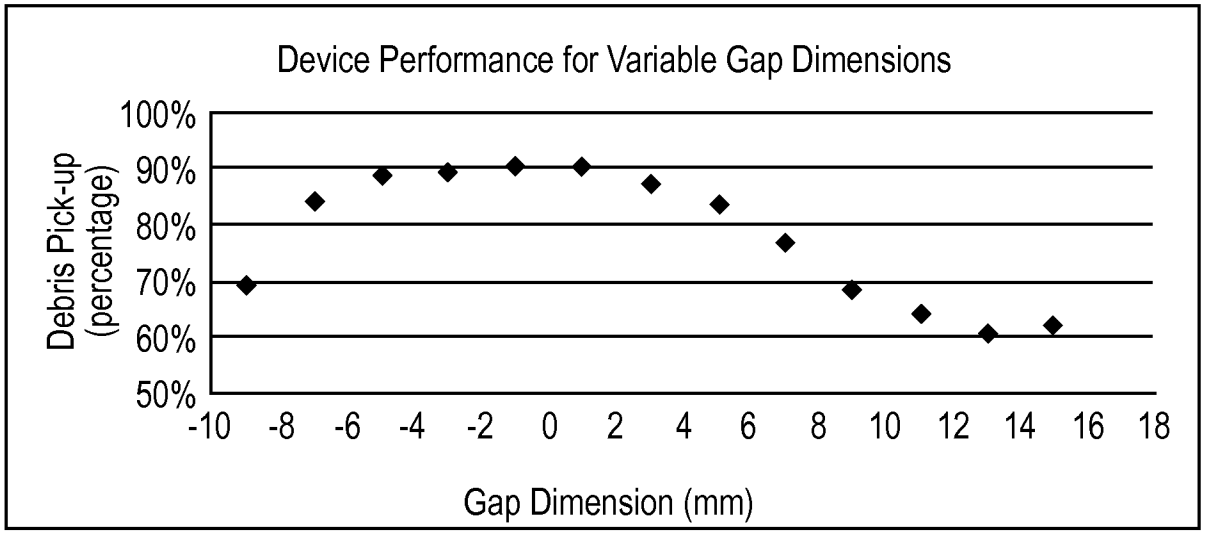
FIG. 5 is a graphical representation of the effect of the gap between the forward distal edge of the sole plate and the lip of the portion of the beater bar housing on debris pickup, showing the performance of an exemplary dual mode cleaning device.

Referring to FIG. 5, it can be seen that the gap (G) directly affects the performance of the cleaning device (10). The performance in FIG. 5 was measured using a commercially available Swiffer® Sweep & Trap™ device (10) sold by the instant assignee for control and using this same Swiffer® Sweep & Trap™ device (10) modified for purposes of this testing. A commercially available control device (10) is understood to have a gap (G) ranging from a space of +5.6 mm to +6.6 mm. The test devices (10) had gaps (G) ranging from −9 mm to +15 mm. A single device (10) was used to control for extraneous variables.

All devices (10) were tested on a tile floor with grout using 0.5 grams/sq. meter large particle debris. A new Swiffer® Sweeper sheet (20) was used for each trial.

Thirteen different gap (G) dimensions were tested. Each gap (G) was tested for n=3 trials, for a total of 39 different tests. But not all gap (G) dimensions performed equally well.

Referring to FIG. 5, it can be seen that performance unexpectedly was greater than 90% total debris pickup for a gap (G) ranging from −1 to +1 mm, was greater than 85% total debris pickup for a gap (G) ranging from −3 to +3 mm, and was greater than 80% total debris pickup for a gap (G) ranging from −7 to +5 mm. For greater gap (G) dimensions, in either the positive or negative senses, performance rapidly decreased. These data are illustrated in Table 1 below.

TABLE 1

| Minimum Total Debris Pickup (percentage) | Gap Overlap (mm) | Gap Space (mm) |
|---|---|---|
| 90 | −1 | +1 |
| 85 | −3 | +3 |
| 80 | −7 | +5 |

Thus a foot (14) according to the present invention may have a gap (G) ranging from an overlap of about −1, −3, −5, −7 or −9 mm, to a space of about +1, +3, or +5 mm, inclusive of any value therebetween, and using any cited endpoint for the range. If measured to a sufficient degree of precision, a foot (14) according to the present invention may have a gap (G) ranging from an overlap of about −1.0, −3.0, −5.0, −7.0 or −9.0 mm, to a space of about +1.0, +3.0, or +5.0 mm, inclusive of any value therebetween, and using any cited endpoint for the range. Or the gap (G) may be 0 mm in a degenerate case, with the distal edge (175) and lip (45) barely in mutual contact.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm". It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

Except as otherwise noted, the articles "a," "an," and "the" mean "one or more." All documents cited in the Background and the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A foot for a cleaning device, said foot having a longitudinal centerline, a front, a rear longitudinally opposed thereto, and two opposed sides connecting said front and said rear, said foot being movable on a surface and comprising:

a housing for holding an axially rotatable beater bar in a portion thereof and having a lip defining an edge of said portion, a sole plate being able to removably receive a disposable cleaning sheet thereon for cleaning of a target surface with the sheet, said sole plate having a distal edge proximate said lip, said lip and said distal edge defining a gap therebetween, said gap ranging from about −7 mm to about +5 mm.

2. A foot according to claim 1 wherein said gap ranges from about −3 mm to about +3 mm.

3. A foot according to claim 2 wherein said gap ranges from about −1 mm to about +1 mm.

4. A foot according to claim 1 wherein said sole plate is movable about a pivot axis, said sole plate being movable between an open position for servicing of the cleaning sheet and a closed position for cleaning tasks.

5. A foot according to claim 4 further comprising a wheel disposed on said axis of said beater bar.

6. A foot according to claim 5 wherein said wheel comprises a single wheel.

7. A foot according to claim 1 wherein said distal end of said sole plate is straight and extends is a widthwise direction.

8. A foot according to claim 7 wherein said lip is tapered.

9. A foot according to claim 7 wherein said lip is disposed about 2 mm to about 4 mm from the target surface in use.

10. A device for cleaning a floor, said device having a front, a rear longitudinally opposed thereto, and two opposed sides connecting said front and said rear, said device comprising:

an elongate handle, a foot, said foot being pivotally connected to said handle, said foot being movable on a floor, said foot having a housing and a sole plate for removably receiving a disposable floor sheet, said sole plate and said housing being articulably joined together, said sole plate comprising a head and a panel joined thereto, whereby said head protrudes from said panel, each of said head and said panel articulating in synchronous relationship with respect to said housing, said housing having an axially rotatable beater bar therein, said beater bar cooperating with a lip disposed on said housing to propel debris towards a dirt bin, said panel having a distal edge proximate said lip and spaced therefrom by a gap, said gap ranging from about −7 mm to about +5 mm.

11. A device according to claim 10 wherein said gap ranges from about −3 mm to about +3 mm.

12. A device according to claim 10 wherein said beater bar is driven by a wheel which rolls on a target surface during cleaning.

13. A device according to claim 10 wherein said foot has a width between two opposed sides, and said beater bar, said lip and said distal edge are substantially equivalent in width to said width of said foot.

14. A device according to claim 13 wherein said lip and said distal edge are both substantially straight and substantially mutually parallel.

15. A device according to claim 14 wherein said lip and said distal edge are both substantially mutually parallel with said beater bar.

16. A device according to claim 15 wherein said gap is about 0 mm.

17. A foot for a cleaning device, said foot having a longitudinal centerline, a front, a rear longitudinally opposed thereto, and two opposed sides connecting said front and said rear, and being movable on a surface, said foot comprising:

a housing holding an axially rotatable beater bar in a portion thereof and having a lip defining a rearward edge of said portion, a sole plate removably joined to said housing, said sole plate being able to removably receive a disposable cleaning sheet thereon without attachment of the cleaning sheet to said housing, said sole plate being movable between an open position for servicing of the cleaning sheet and a closed position for cleaning tasks, said sole plate having a distal edge proximate said lip, said lip and said distal edge defining a gap therebetween, said gap ranging from about −7 mm to about +5 mm.

18. A foot according to claim 17 wherein said gap ranges from about −3 mm to about +3 mm.

19. A foot according to claim 18 wherein said gap ranges from about −1 mm to about +1 mm.

20. A foot according to claim 19 wherein said gap is about 0 mm.

* * * * *